US009994361B2

(12) United States Patent
Ring et al.

(10) Patent No.: US 9,994,361 B2
(45) Date of Patent: Jun. 12, 2018

(54) APPARATUS FOR APPLYING A HANDLE TO A CONTAINER AND METHOD THEREOF

(71) Applicant: RING Container Technologies, LLC, Oakland, TN (US)

(72) Inventors: Carl Ring, Memphis, TN (US); Doug Dygert, Olive Branch, MS (US); Dan Futral, Somerville, TN (US)

(73) Assignee: Ring Container Technologies, LLC, Oakland, TN (US)

( * ) Notice: Subject to any disclaimer, the term of this patent is extended or adjusted under 35 U.S.C. 154(b) by 294 days.

(21) Appl. No.: 14/438,964

(22) PCT Filed: Nov. 20, 2013

(86) PCT No.: PCT/US2013/070875

§ 371 (c)(1),
(2) Date: Apr. 28, 2015

(87) PCT Pub. No.: WO2014/081750

PCT Pub. Date: May 30, 2014

(65) Prior Publication Data

US 2015/0291310 A1 Oct. 15, 2015

Related U.S. Application Data

(60) Provisional application No. 61/728,547, filed on Nov. 20, 2012.

(51) Int. Cl.
*B23P 11/00* (2006.01)
*B65D 23/10* (2006.01)
(Continued)

(52) U.S. Cl.
CPC ..... *B65D 23/106* (2013.01); *B65B 61/14* (2013.01); *B65D 1/023* (2013.01); *B65D 1/0246* (2013.01); *B65D 23/108* (2013.01)

(58) Field of Classification Search
CPC ..... B23P 11/00; B23P 11/005; B23P 11/022; B23P 13/00; B23P 17/00; B23P 19/00
See application file for complete search history.

(56) References Cited

U.S. PATENT DOCUMENTS 3,036,371 A * 5/1962 Gray ..... A47J 45/065 215/397
3,690,141 A 9/1972 Brownbill
(Continued)

FOREIGN PATENT DOCUMENTS

EP 2028108 A1 2/2009
ES 1 045 049 U 7/2000

OTHER PUBLICATIONS

European Examination Report, dated Mar. 10, 2017, European patent application 13 856 885.2 (2 922 759).
(Continued)

*Primary Examiner* — Lee D Wilson
(74) *Attorney, Agent, or Firm* — Sorell Lenna & Schmidt, LLP

(57) ABSTRACT

A method for applying a handle to a container, including placing the handle on the neck of the container, supporting the container to prevent the container from collapsing, and moving the handle toward an end of the neck that contacts a body of the container. The neck includes a supporting rib to fix the handle to the container.

20 Claims, 18 Drawing Sheets

(51) Int. Cl.
*B65B 61/14* (2006.01)
*B65D 1/02* (2006.01)

(56) References Cited

U.S. PATENT DOCUMENTS 3,780,492 A 12/1973 Corderoy
3,987,535 A * 10/1976 Brown ..... B67B 7/182 29/426.4
4,236,305 A * 12/1980 Hetherington ..... A47J 45/065 215/399
4,939,890 A 7/1990 Peronek et al.
5,259,912 A 11/1993 Cline
5,768,767 A 6/1998 Burchell et al.
6,082,078 A 7/2000 Weber et al.
6,977,104 B1 12/2005 Nahill et al.
2004/0238475 A1* 12/2004 Peronek ..... B65D 1/023 215/40
2005/0236356 A1 10/2005 Lonsway
2007/0272651 A1 11/2007 Dipasquale et al.
2011/0305545 A1* 12/2011 Davis ..... G07F 11/165 414/225.01
2013/0291493 A1* 11/2013 Laudet ..... B65B 5/08 53/475
2015/0291310 A1* 10/2015 Ring ..... B65B 61/14 29/453
2016/0362208 A1* 12/2016 Papsdorf ..... B65B 35/44
2016/0362254 A1* 12/2016 Papsdorf ..... B65B 35/44
2016/0362259 A1* 12/2016 Papsdorf ..... B65B 35/44

OTHER PUBLICATIONS

European Search Report, dated Jun. 9, 2016, European patent application 13 856 885.2 (2 922 759).
International Search Report of PCT/US2013/070875 dated Apr. 14, 2014.

* cited by examiner

APPARATUS FOR APPLYING A HANDLE TO A CONTAINER AND METHOD THEREOF

CROSS-REFERENCE TO RELATED APPLICATIONS

This application is a National Stage of International Application No. PCT/US2013/070875, filed Nov. 20, 2013, claiming priority based on U.S. Patent Application No. 61/728,547, filed on Nov. 20, 2012, the contents of which are incorporated herein by reference in their entirety.

BACKGROUND

1. Field

The present invention relates to container handle. More specifically, the invention is directed to a handle configured to be applied to a container being lighter in weight than a conventional container.

2. Related Art

The general use of applying a handle to a container, such as a bale handle, is known in the art. The containers are typically stretch blown containers made of PET and an injection molded handle is typically applied to the container after molding. Such handles are typically applied to containers by simply being pressed over the threads of mouth of the container.

In recent years, consumers have become more environmentally aware and product suppliers are trying to meet their demands for less packaging materials. With the increased cost of resins used to produce containers and the desire to decrease weight of the containers, the industry is demanding more lighter weight containers. However, the lighter weight containers that are desired are not strong enough to resist the force required to apply the typical handle, and thus restricts how light a container can be made and still be strong enough to withstand the application force.

Therefore, there is a need for a solution to place a handle on lighter weight containers.

SUMMARY

The present invention was developed to improve the application of handles of the related art. In particular, the novel apparatus and method thereof explained herein differs from any previous apparatus and method because it applies a handle to the container using the mouth of the container as support. Moreover, with the present invention, handles can be attached to light weight containers without having these containers collapse under the force of the application of these handles.

According to an exemplary embodiment, there is provided a method for applying a handle to a container, including placing the handle on a neck of the container, supporting the container to prevent the container from collapsing, and moving the handle toward an end of the neck that contacts a body of the container, wherein a supporting rib on the neck fixes the handle to the container.

The supporting the container may include having a neck guide rail engage a finish on the neck while the handle is placed on the neck of the container.

The moving the handle may include engaging a bead on the neck of the container with a support plate and pushing the handle toward the body of the container with a handle punch.

The moving the handle may include engaging the handle with an application chuck and simultaneously rotating and moving the application chuck toward the container, wherein the application chuck screws the handle to the neck.

According to another aspect of an exemplary embodiment, compressed gas may be placed in the container before the moving the handle is performed.

The moving the handle may include engaging threads on the neck of the container with a threaded application chuck and rotating the threaded application chuck onto the neck of the container.

The rotating the threaded application chuck onto the neck of the container may push the handle toward the body of the container.

According to another aspect of an exemplary embodiment, there is provided an apparatus for applying a handle to a container, including neck guide rail to support the container, a handle guide rail to move the handle into a position above a neck of the container, and a handle applicator for applying the handle onto the neck of the container.

The handle applicator for applying the handle may include a plurality of support plates to support the container and a handle punch that pushes the handle onto the neck of the container.

In yet another exemplary embodiment, the apparatus may include a bead at a sealing end of the neck.

The plurality of support plates may support the container by grasping the bead at the sealing end of the neck before the handle punch pushes the handle onto the neck of the container.

In yet another exemplary embodiment, the plurality of support plates includes at least one cutout.

In yet another exemplary embodiment, the handle applicator includes an application chuck that can rotate to apply the handle to the neck.

The application chuck may include a member that contacts the handle to screw the handle to the neck.

The handle applicator may include a threaded application chuck that interacts with threads on the neck of the container to apply the handle onto the neck of the container.

In yet another exemplary embodiment, a tube is releasably attached to a sealing surface of the neck.

In yet another exemplary embodiment, a compressed gas is pumped through the tube into the container.

The neck may be more rigid than a body of the container.

According to another aspect of an exemplary embodiment, there is provided a method for supporting a neck of a container, including placing a device in the neck and expanding the device diametrically to engage the neck.

The engaging the neck may increase the rigidity of the neck.

BRIEF DESCRIPTION OF THE DRAWINGS

The above and other objects, features, and advantages of the present invention will become more readily apparent from the following detailed description of exemplary embodiments of the invention, taken in conjunction with the accompanying drawings, in which.

DETAILED DESCRIPTION OF THE INVENTION

Figure 1:
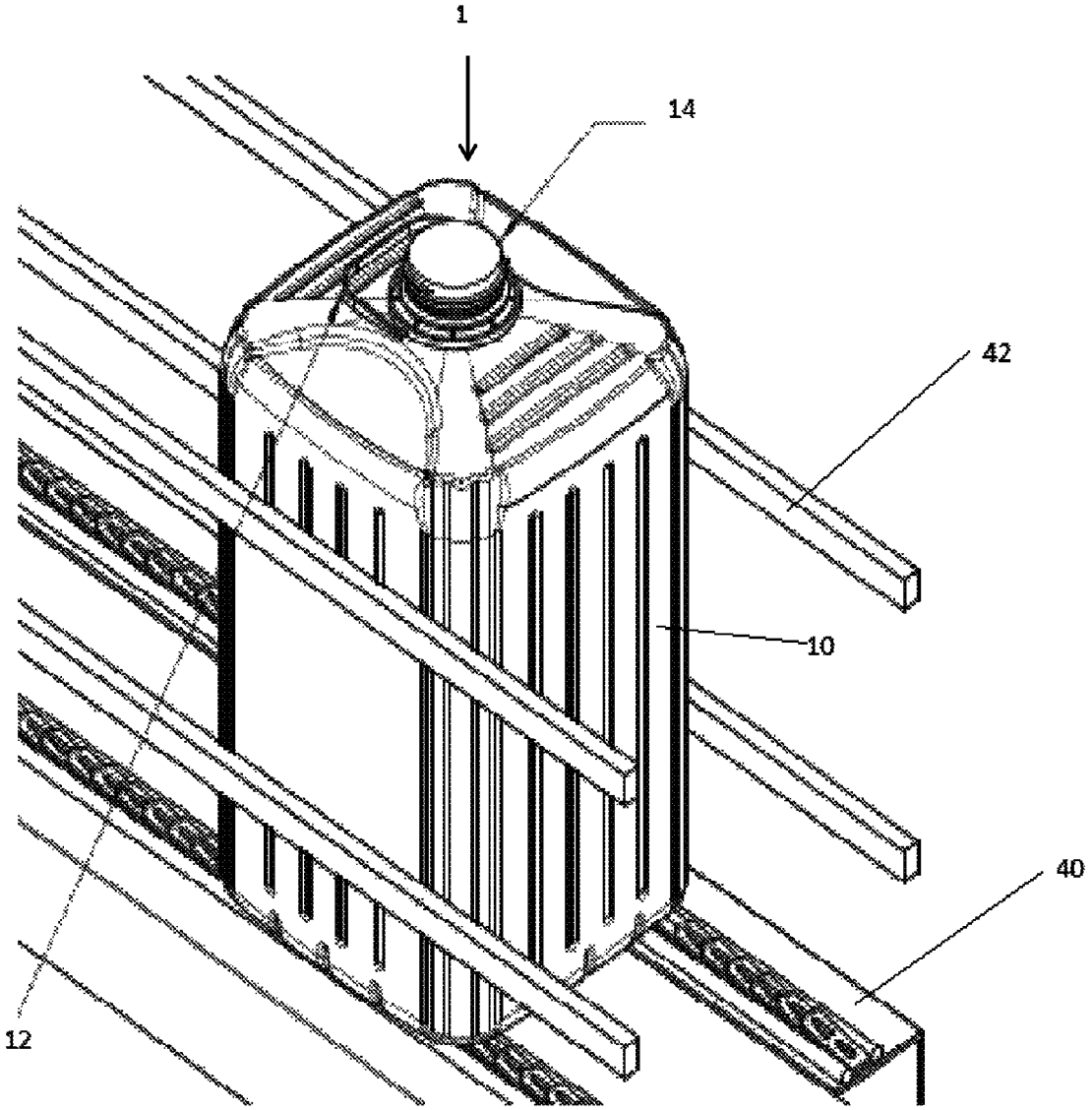
FIG. 1 is a 3-D view of a finished container.

Exemplary embodiments will now be described more fully with reference to the accompanying drawings. The exemplary embodiments, however, may be embodied in many different forms and should not be construed as being limited to the embodiments set forth herein; rather, these exemplary embodiments are provided so that this disclosure will be thorough and complete, and will fully convey the concept of the disclosure to those skilled in the art. In the drawings, the size of the various components may be exaggerated for clarity. Like reference numerals in the drawings denote like elements, and thus their description will be omitted.

FIG. 1 is an exemplary embodiment of a container 1 having a container body 10, a handle 12, and a container cap 14.

Figure 2:
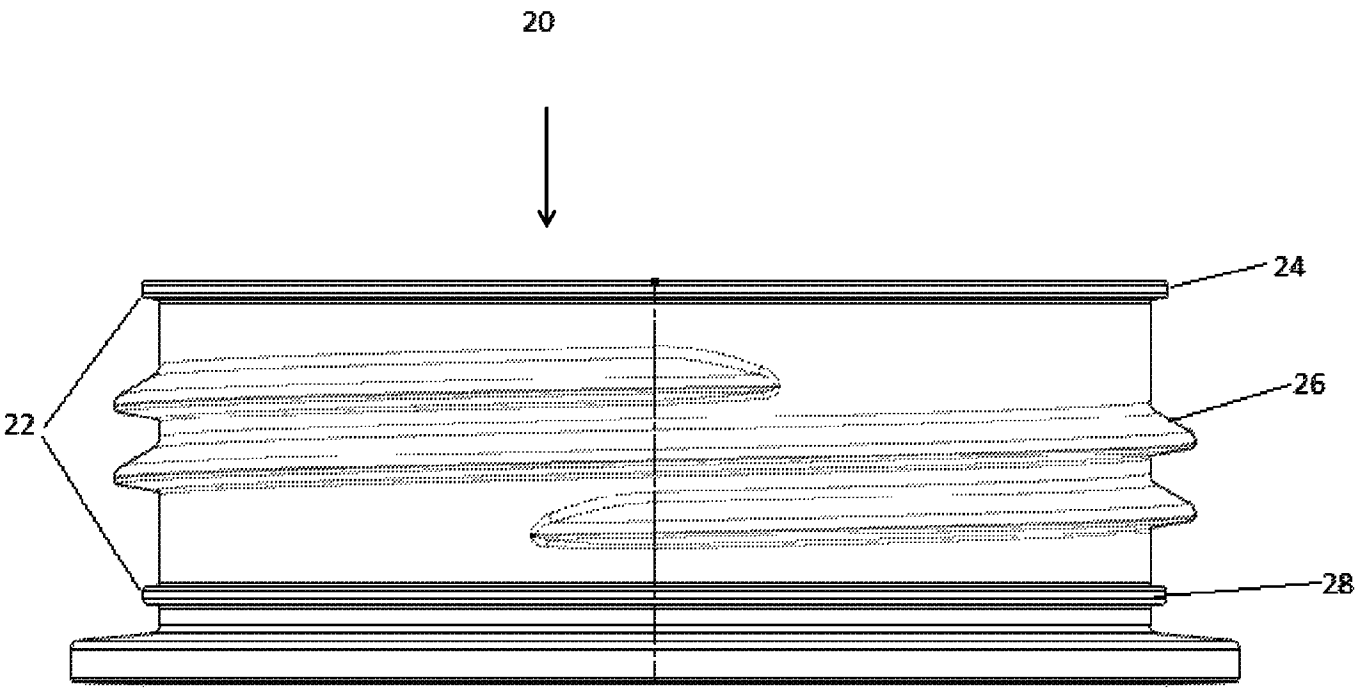
FIG. 2 is a side view of a neck showing threads on the neck.

As shown in FIG. 2, an exemplary embodiment of the container 1 has a neck 20 having threads 26 and a finish 22, where the finish 22 extends along the diameter of the neck 20 without interfering with threads 26. The finish 22 has a bead 24 at the sealing surface of the neck 20. The bead 24 is molded at the sealing surface to increase the width of the seal surface and extend down the diameter of the finish 22, without interfering with the threads 26. In addition, a support ring 28 is molded along the diameter of the finish 22 at an end of the neck 20 opposite of the sealing surface, at a location just before the neck 20 meets the container body 10.

Figure 3:
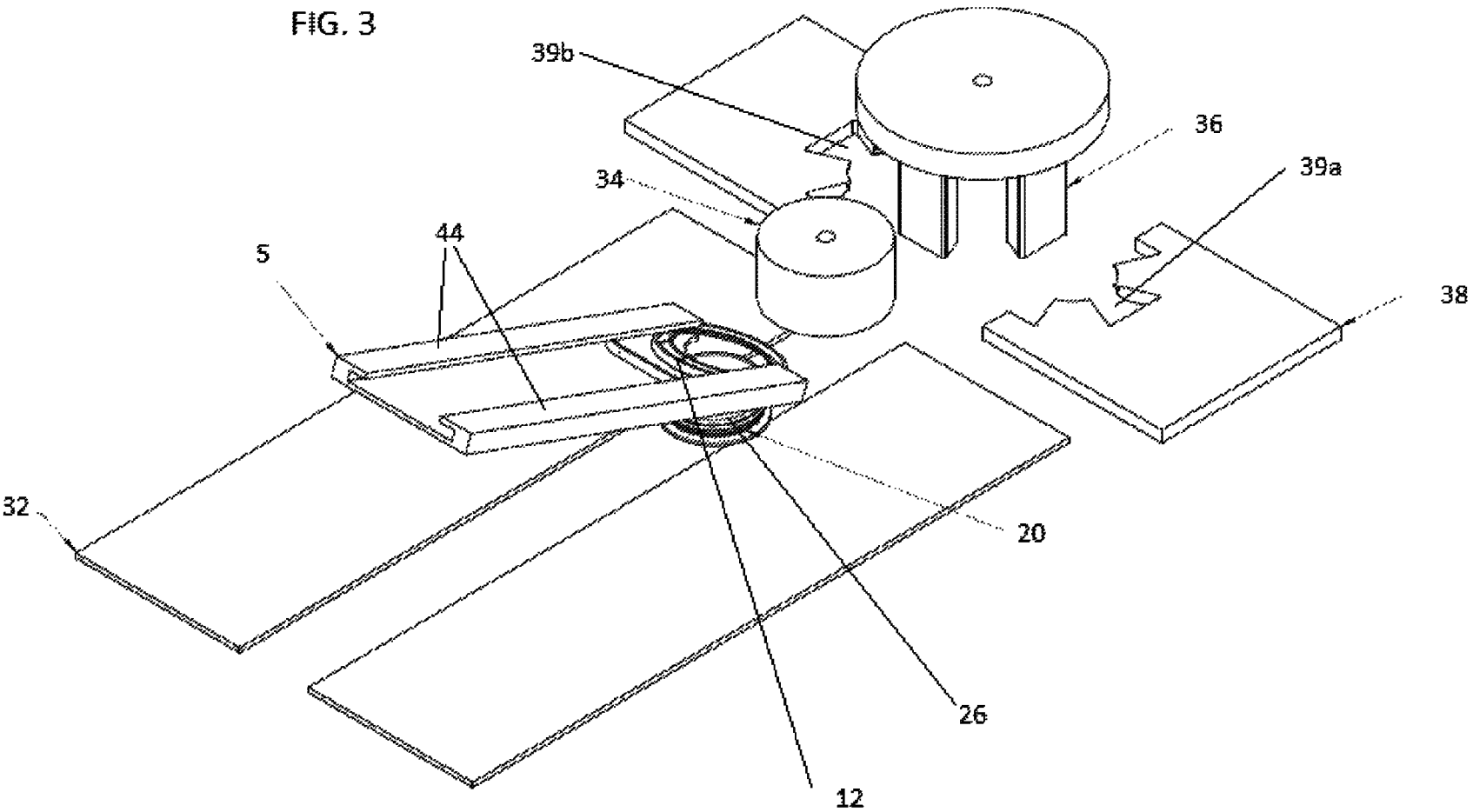
FIG. 3 is a top view showing a handle being placed on a neck of a container.

The handle 12, shown in FIG. 3, has a circular portion 12*a* that can attach around the neck 20 of the container 1. There is also provided a handle member 12*b* on the handle 12.

Figure 4:
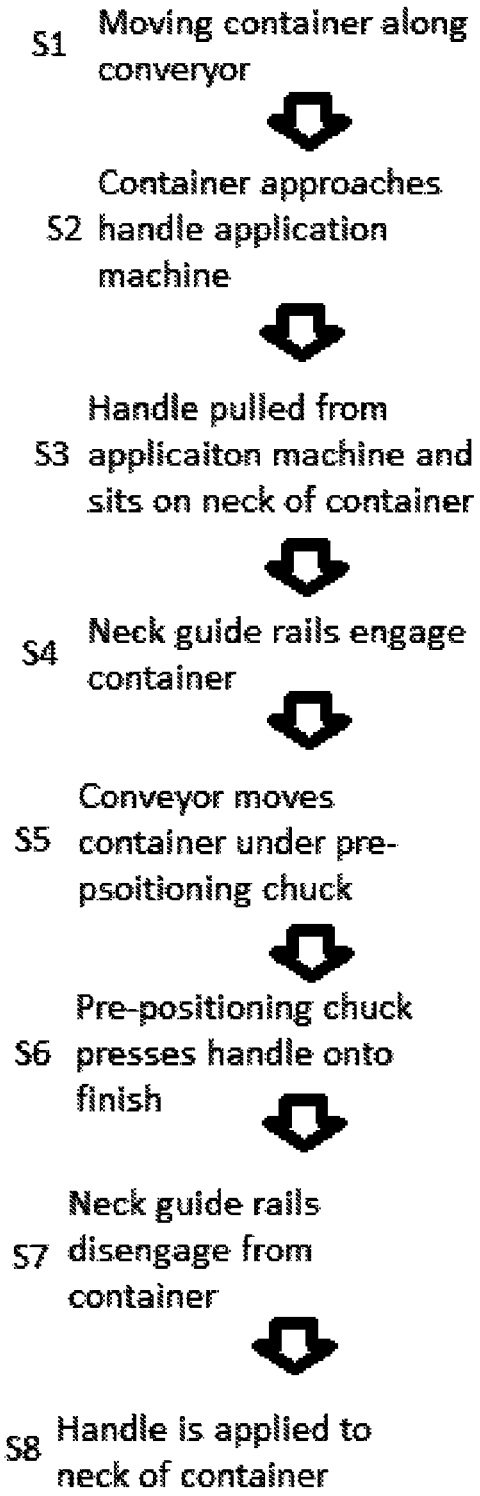
FIG. 4 is a block diagram showing an exemplary embodiment of applying a handle to a container.
Figure 5:
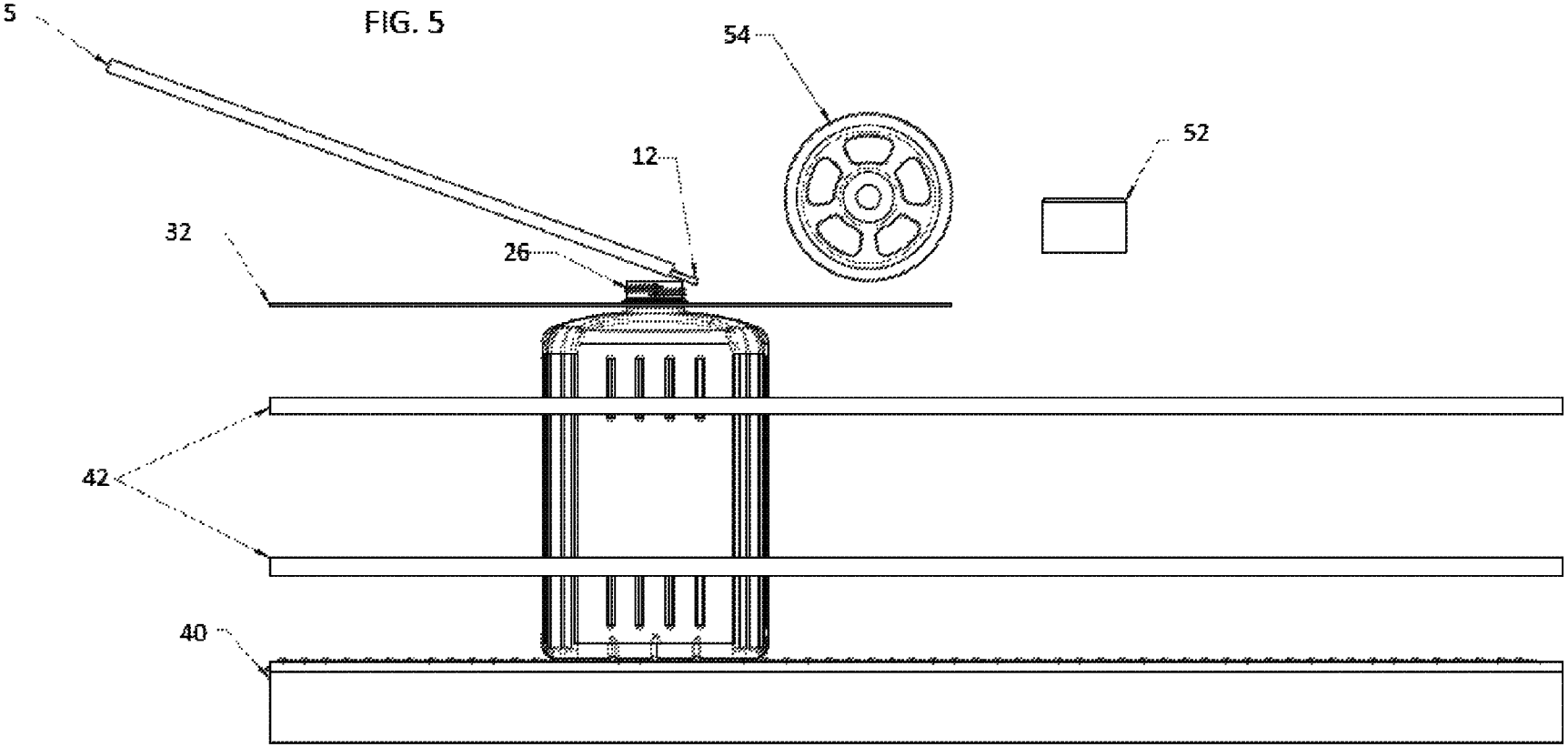
FIG. 5 is a side view showing a handle being placed on a neck of a container.

In one exemplary embodiment, a method for applying a handle 12 to a container 1 is shown in FIG. 4. At step S1, the container 1 travels along a conveyor 40, as shown in FIG. 5. The conveyor 40 may have conveyor guide rails 42 to prevent the container 1 from falling off the conveyor 40. The conveyor 40 may be a table-top conveyor, air conveyor, or the like.

The container 1 approaches an outlet of the handle application machine 5 at step S2, where the handle 12 is oriented so that the circular portion 12*a* is in a forward position of the handle member 12*b*. The handle 12 is supported on the handle application machine 5 by handle guide rails 44. As shown in FIG. 3, the handle 12 exits the handle application machine 5 at step S3, with circular portion 12*a* exiting first so that it sits on the neck 20. The handle application machine 5 is angled to allow the handle 12 to be pulled off handle application machine 5 when the circular portion 12*a* contacts the neck 20 of the container 1. It will be understood that the handle application machine 5 may be disposed at any angle, and can move the handle 12 along handle guide rails 44 using gravity or by a conveyor-belt-like system (not shown).

As shown in FIG. 3, neck guide rails 32 may engage the finish 22 of the container at step S4. This can occur either before or after the handle 12 is pulled off handle application machine 5. Neck guide rails 32 will engage the container 1 just below the support rib 28 of the finish 22 and provide support to the container 1 during positioning of the handle 12.

Figure 6A:
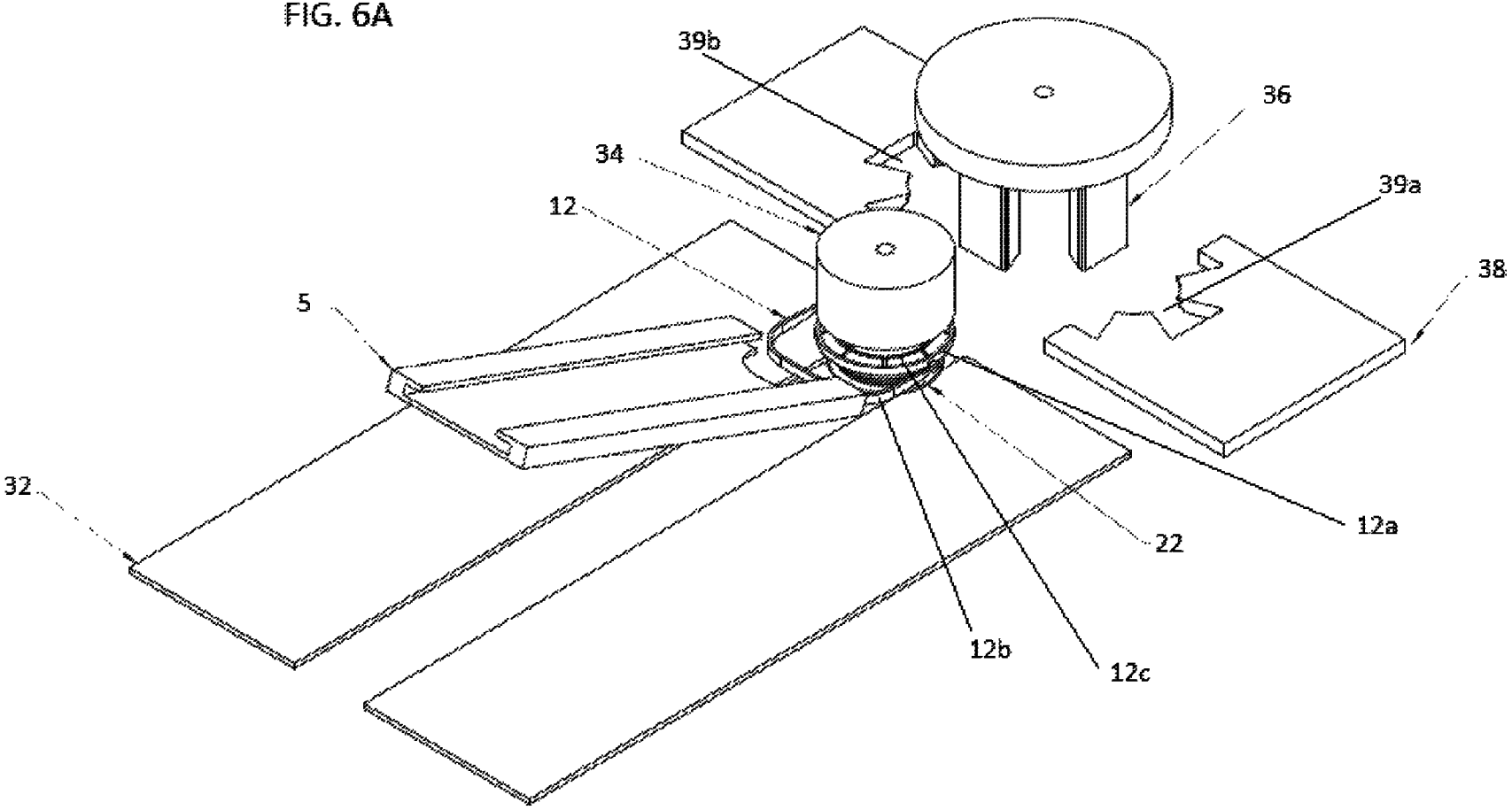
FIG. 6A is a top view showing a pre-positioning chuck aligning a handle on a container.
Figure 6B:
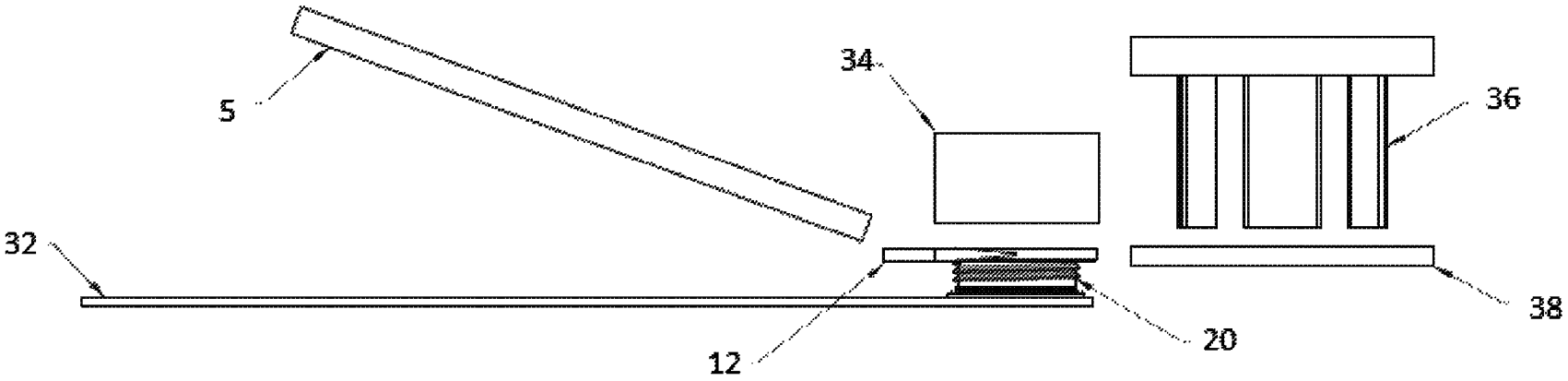
FIG. 6B is a side view showing a pre-positioning chuck aligning a handle on a container.

At step S5, the conveyor moves the container 1 forward until the container 1 is under the pre-positioning chuck 34, as shown in FIGS. 6A and 6B. At step S6, the pre-positioning chuck 34 presses the handle 12 approximately halfway down the finish 22. The neck guide rails 32 oppose the force exerted by the pre-positioning chuck 34, allowing light weight containers to have handles applied to them. It will be understood that the pre-positioning chuck 34 is but one way to position handle 12, and the handle 12 may be positioned using any method known in the art, including rollers or a ramp system.

Figure 7:
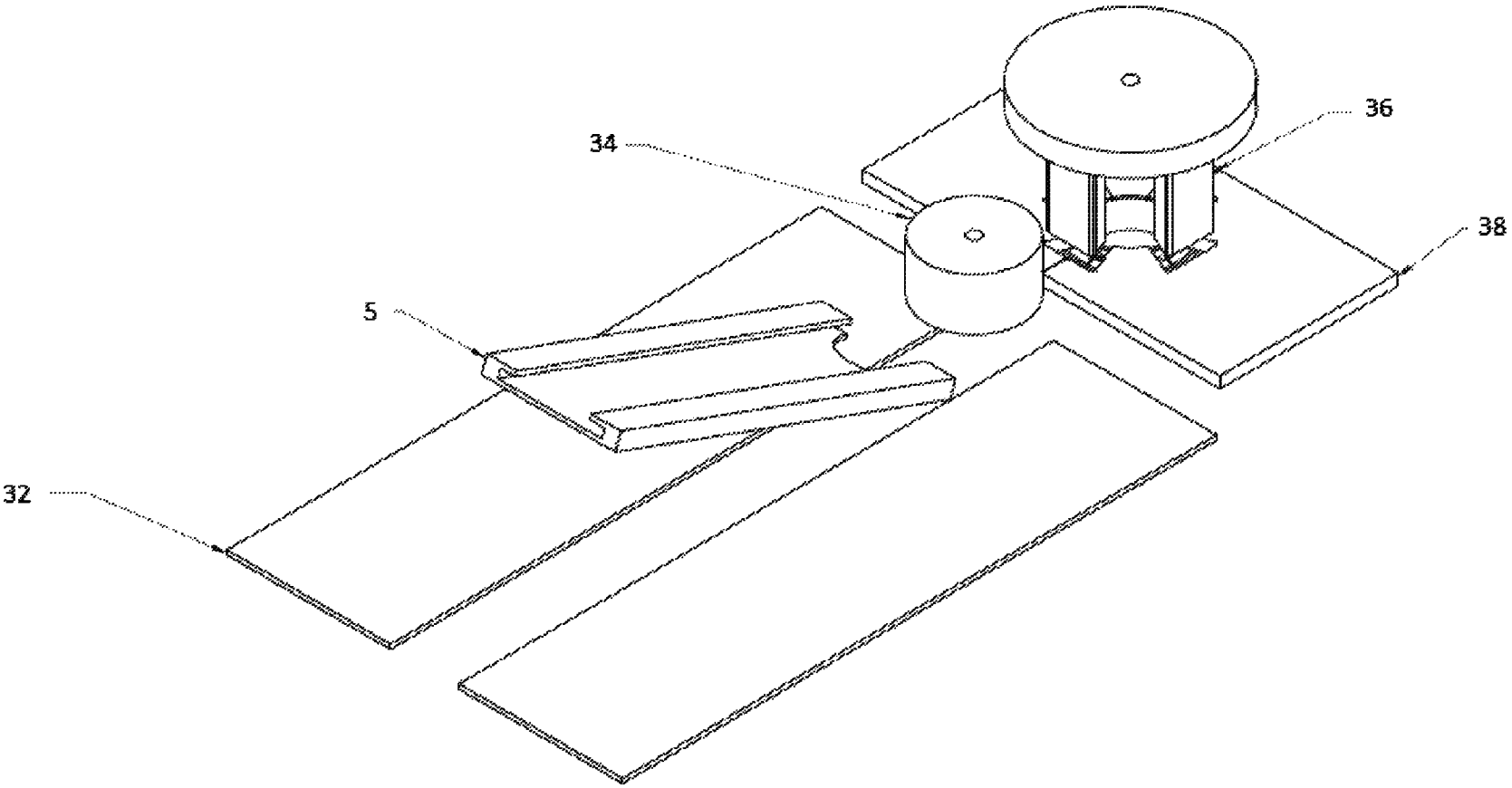
FIG. 7 is a top view showing support plates grasping a neck of a container.
Figure 8:
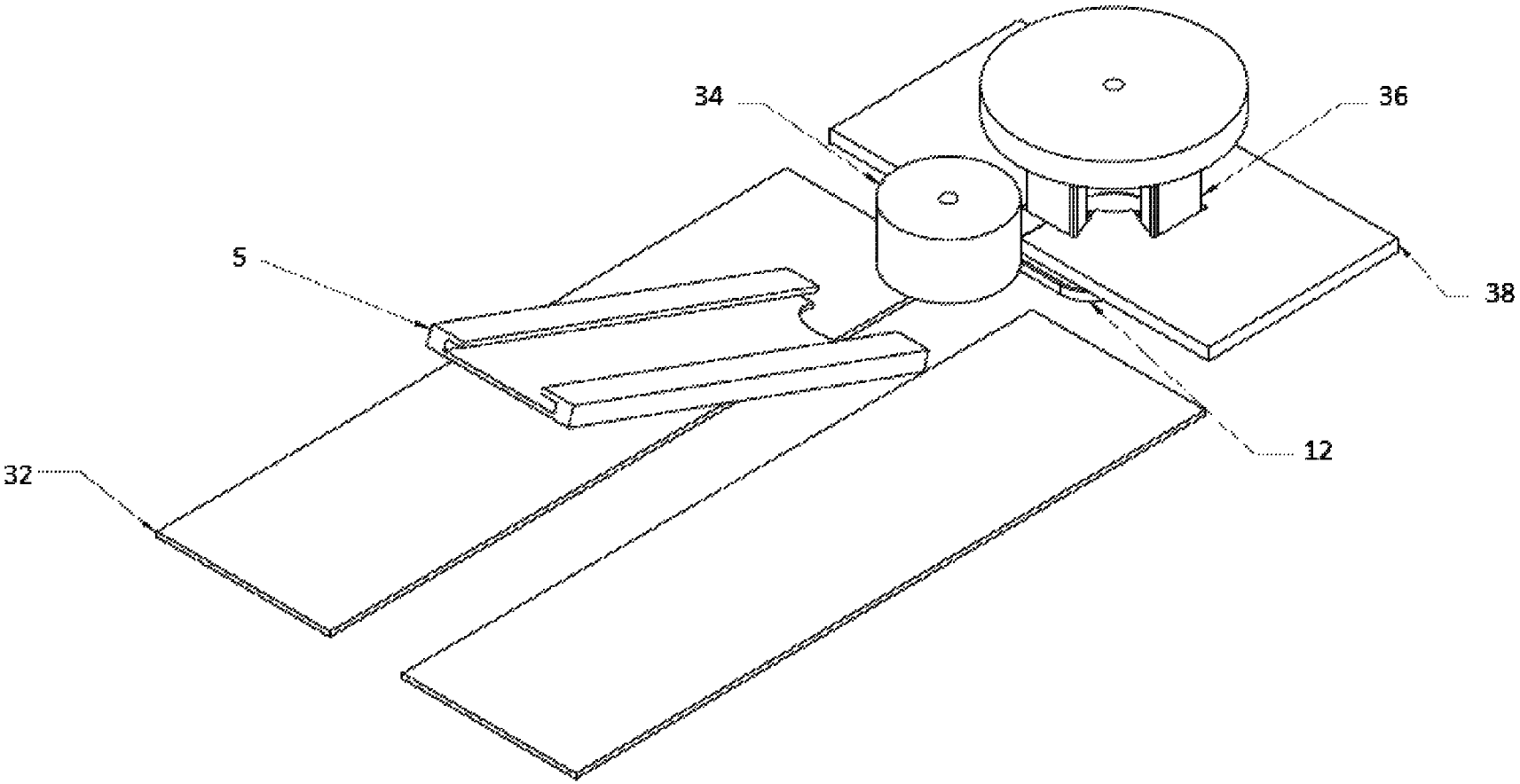
FIG. 8 is a top view showing a handle punch pushing a handle onto a neck of a container.

Once the positioning of the handle 12 has been accomplished, the conveyor 40 moves the container 1 forward, allowing the neck 20 to disengage from the neck engaging rails 32 at step S7. The container 1 is positioned under the handle punch 36 where, as shown in FIG. 7 and step S8, support plates 38 clamp the finish 22 on the bead 24 formed at the sealing surface of the neck 12. Once the bead 24 has been clamped, the handle punch 36 is lowered through cutouts 39*a*, 39*b* on support plates 38 as shown in FIG. 8. The handle punch 36 is lowered and contacts the handle 12, pushing the handle 12 over threads 26 and under support rib 28, where handle 12. Once the handle 12 is secured under support ring 28, the handle punch 36 is raised and the support plates 38 are removed from the bead 24 of the finish 22.

Figure 9:
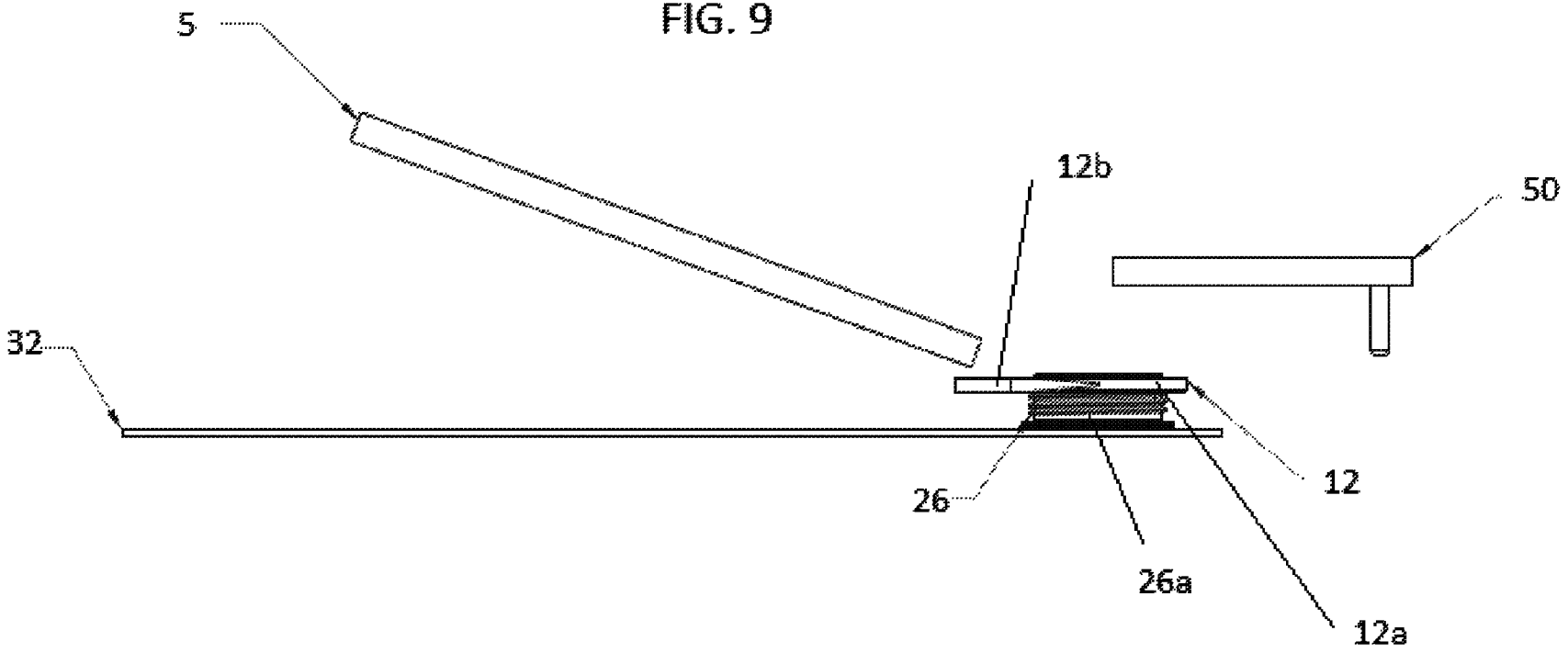
FIG. 9 is a side view showing an exemplary embodiment of an apparatus to screw a handle onto a neck of a container.

In yet another embodiment, the handle 12 may be applied to the container 1 by screwing the handle 12 onto the neck 20. In this exemplary embodiment, threads 26 contain more thread turns than necessary for attaching container cap 14. As shown in FIG. 9, the thread pitch of threads 26 decrease toward the end of neck 20, where neck 20 connects to container 1. Threads 26 form extended threads 26*a*, forming a support that is essentially horizontal, allowing the handle 12 to attach to the container 1 by inner tabs 12*c*.

Figure 10A:
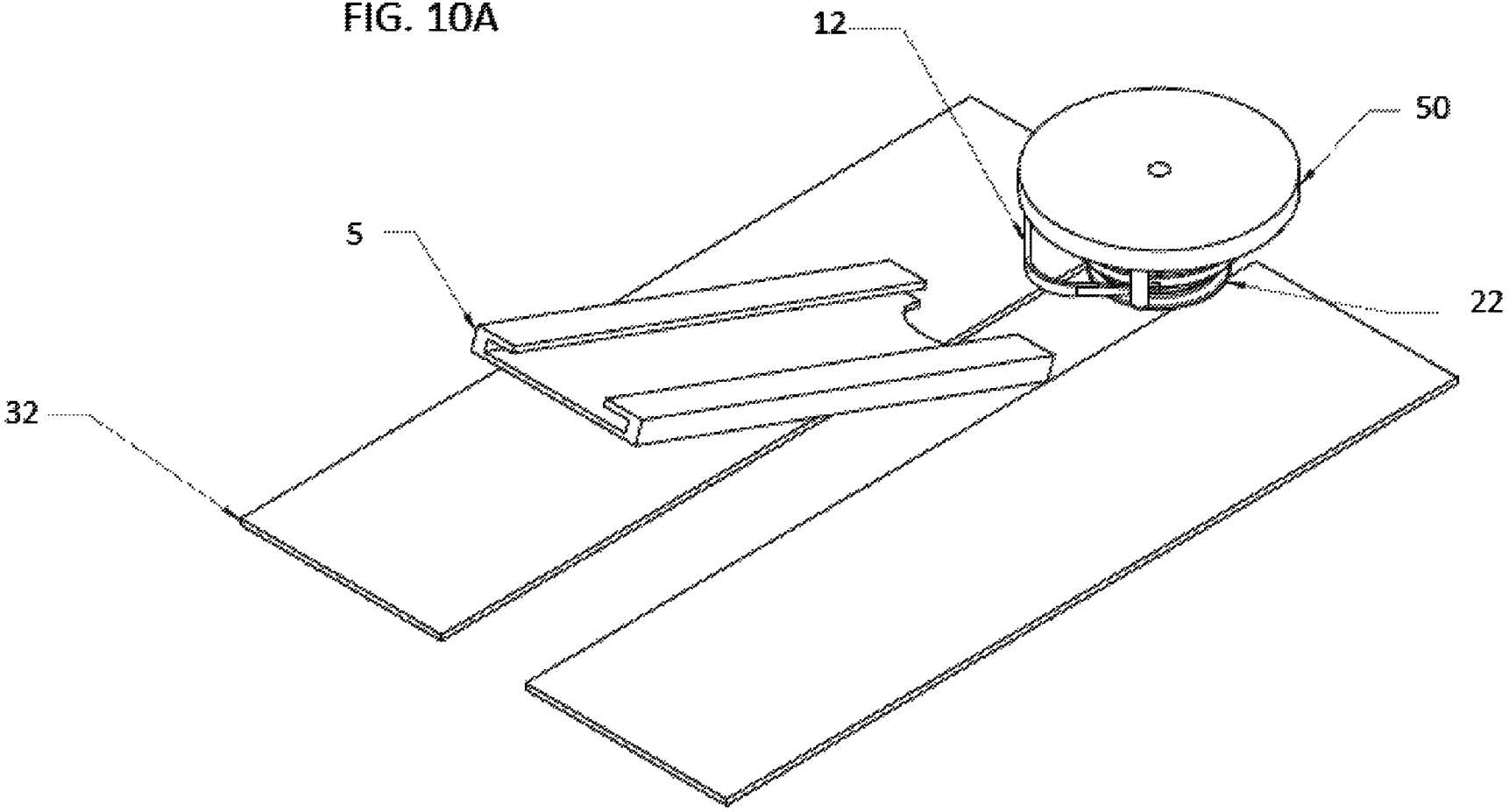
FIG. 10A is a top view of showing an application chuck screwing a handle onto a neck of a container.
Figure 10B:
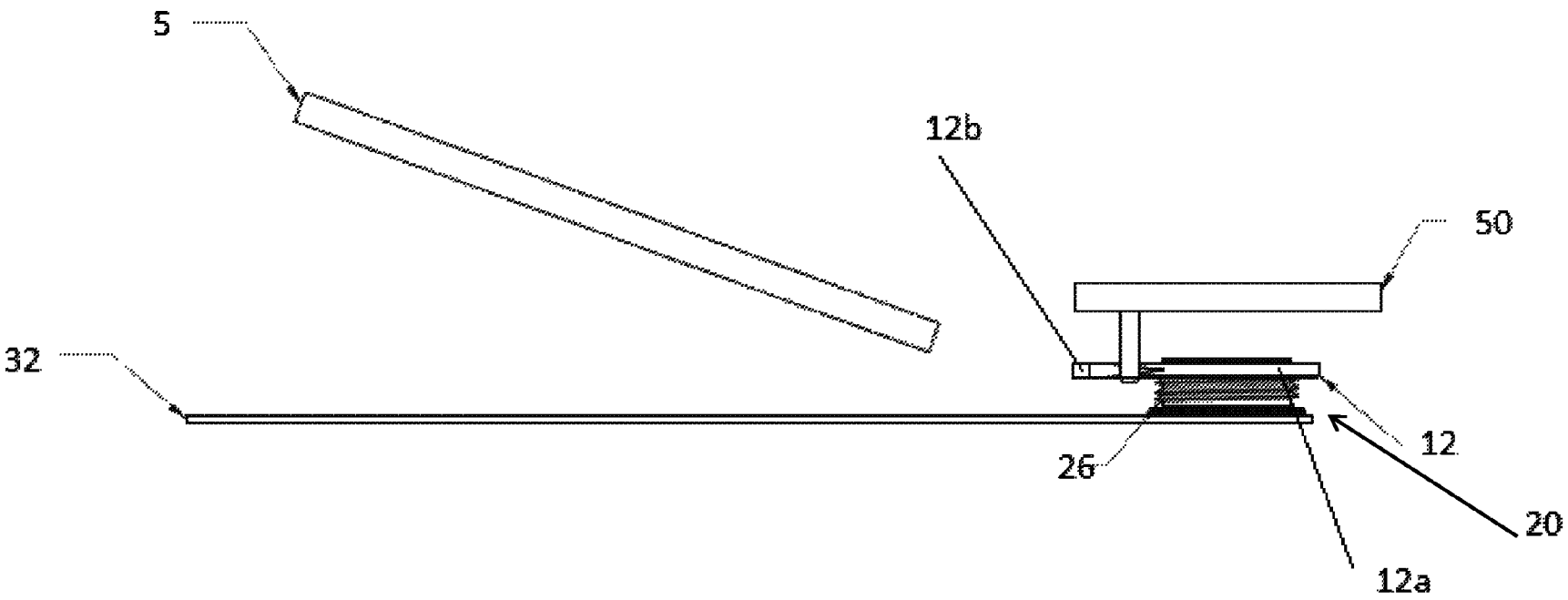
FIG. 10B is a side view of showing an application chuck screwing a handle onto a neck of a container.

The handle 12 is applied to the neck 20 of container 1 as in steps S1-S7. Once the handle 12 is placed on the neck 20, the container 1 moves forward, disengaging neck 20 from the neck engaging guide rails 32, until container 1 is positioned under the application chuck 50. At step 8, the application chuck 50 is lowered and engages the handle 12, as shown in FIGS. 10A and 10B. The application chuck 50 is simultaneously rotated and lowered so that inner tabs 12*c* of the handle 12 engage the threads 26 of the container 1, allowing the handle 12 to be screwed onto the neck 20. The application chuck 50 rotates the handle 12, allowing inner tabs 12*c* and threads 26 to engage, until the handle 12 has been screwed to the neck 20. The inner tabs 12*c* engage with extended threads 26*a*, preventing the handle 12 from falling off and providing the support necessary for the container 1 to be lifted using handle 12.

During the simultaneous rotation and lowering of the application chuck 50 to twist the handle 12 onto the finish 22, conveyor guide rails 42 prevent the container 1 from rotating. However, it will be understood that the invention is not limited to the conveyor guide rails 42 to prevent the container 1 from rotating during the described handle 12 application.

Figure 11:
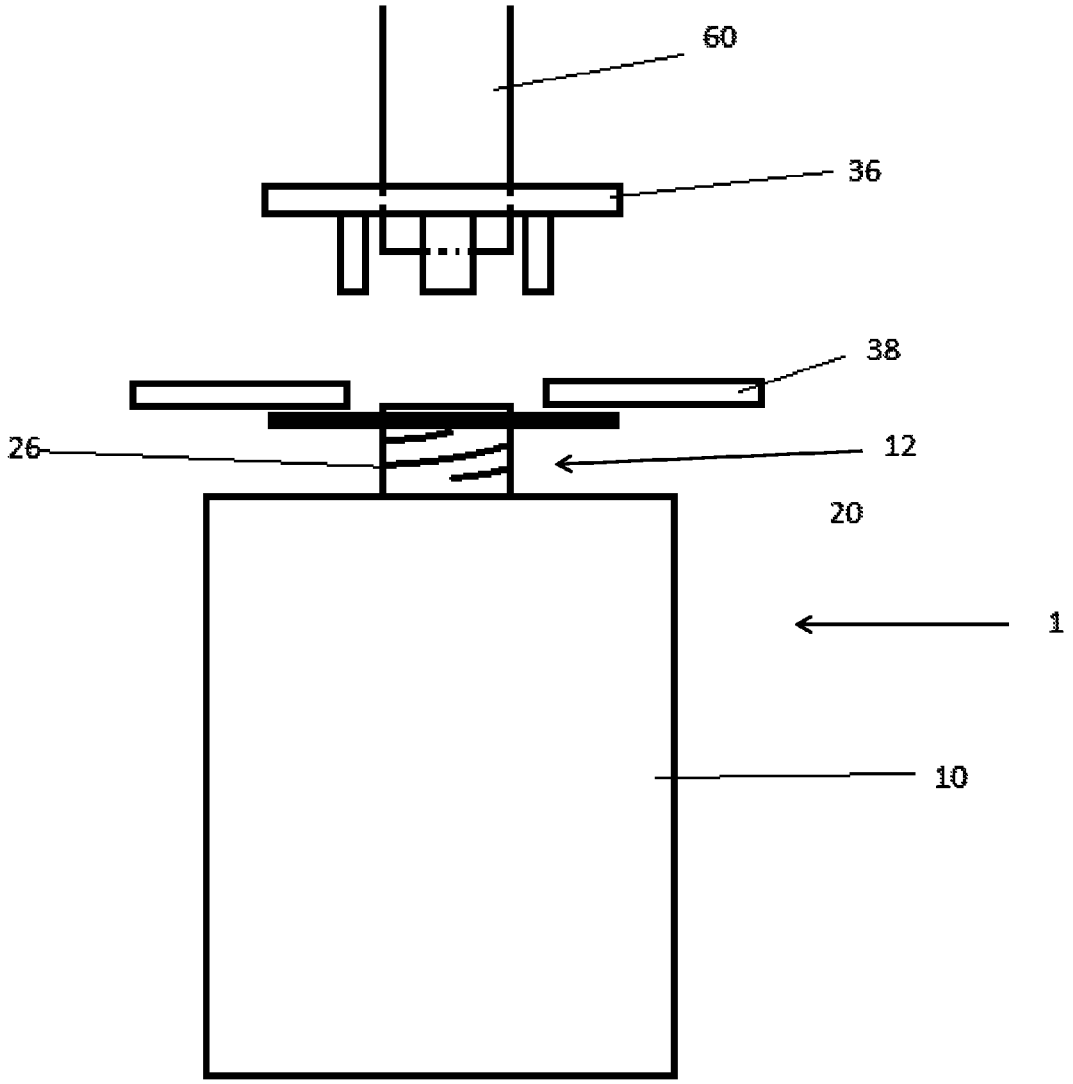
FIG. 11 is a side view of an exemplary embodiment of an apparatus that can push a handle onto a neck of a container with a tube that can pump a compressed gas into the container.

In another exemplary embodiment, the container 1 travels along the conveyor 40 and the handle 12 is placed on the neck 20 as described in the above exemplary embodiments and illustrated by steps S1-S7 of FIG. 4. Neck guide rails 42 engage the container 1 under the finish 22 of the neck 20. After the handle 12 has been aligned, the support plates 38 may grasp the bead 24. In this exemplary embodiment, the handle punch 36 contains a hole 36*a* in the center, as shown in FIG. 11, through which a tube 60 may extend.

The tube 60 contacts the sealing surface of the neck 20 and a compressed gas is released into the container 1. The compressed gas increases the pressure inside the container and provides more rigidity to the container 1. Once the compressed gas is added, the handle punch 36 descends around the tube 60 and pushes the handle 12 into the proper position on the neck 20. The handle punch 36, support plates 34, and tube 60 are then removed from the container 1 and the compressed gas escapes. The support plates 38 may grasp the bead 24 before or after the tube 60 contacts the sealing surface of the neck 20, and the handle punch 36, support plates 34, and tube 60 may be removed from the container 1 in any order.

Figure 12:
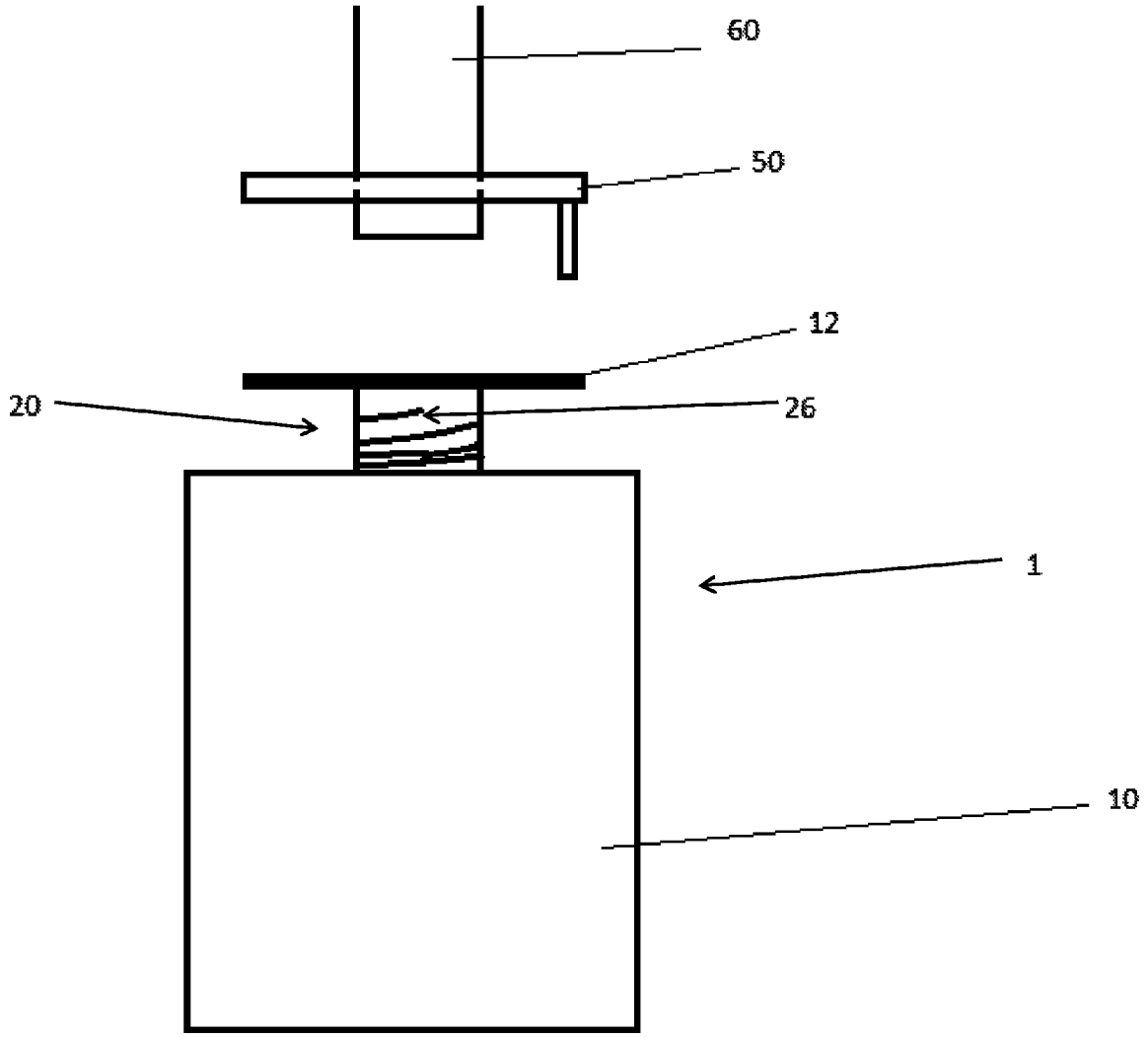
FIG. 12 is a side view of an exemplary embodiment of an apparatus that can screw a handle onto a neck of a container with a tube that can pump a compressed gas into the container.

As shown in FIG. 12, the compressed gas may also be added to the container 1 when applying the handle 12 to the container 1 by using the application chuck 50. The tube 60 is lowered and contacts the sealing surface of the neck 20 after the handle 12 has been placed on the neck 20. Compressed gas is released into the container 1 through tube 60. The application chuck 50 is then simultaneously rotated and lowered, thereby screwing the handle 12 onto neck 20.

Figure 13:
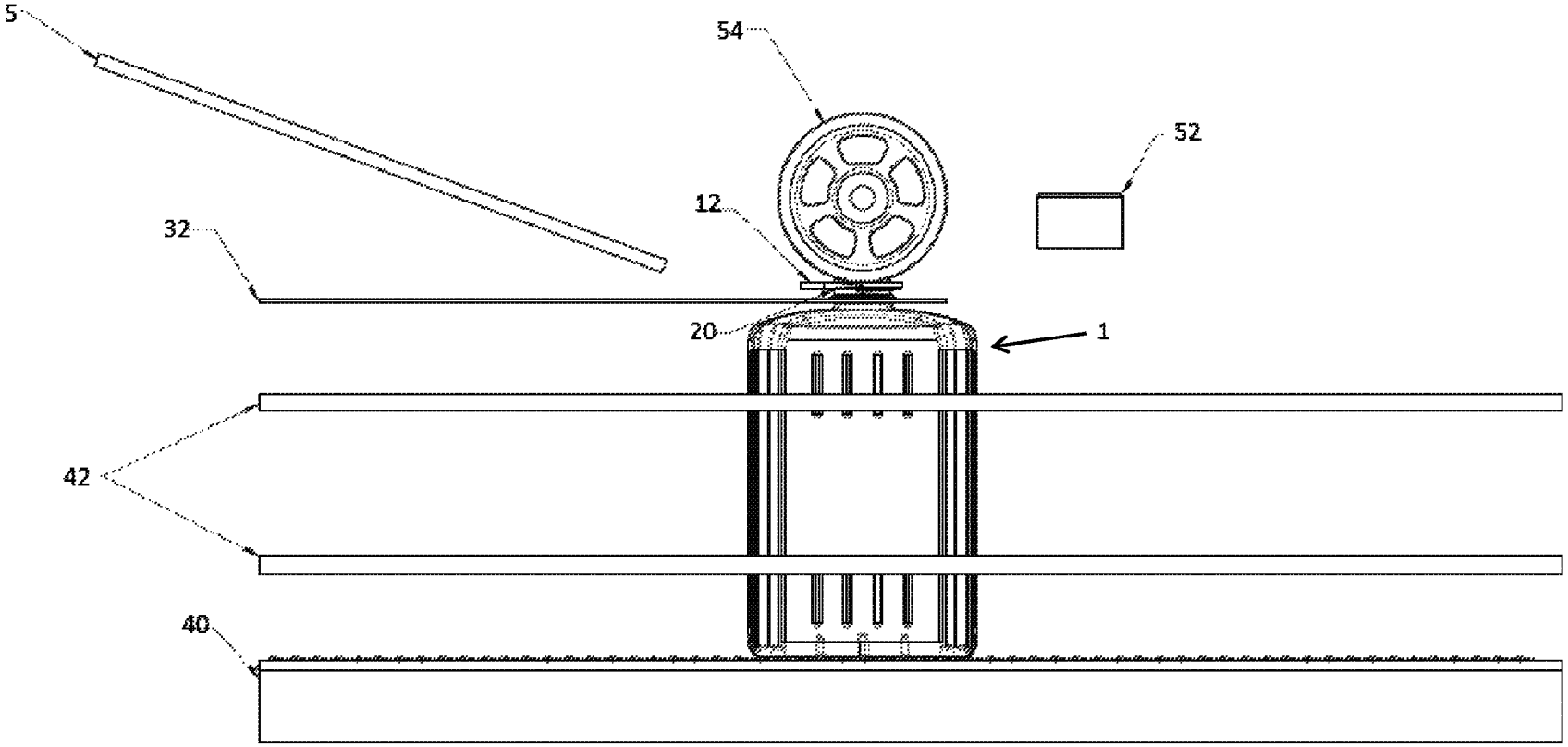
FIG. 13 is a side view showing an exemplary embodiment of aligning a handle on a neck of a container.

In yet another embodiment, the handle 12 may be applied to the container 1 by a threaded application chuck 52. As shown in FIG. 5, the container 1 travels along a conveyor belt 40. Similar to the above-described embodiments, the handle 12 is placed on the neck 20 of the container 1. Neck guide rails 42 engage the container 1 under the finish 22 of the neck 20. The conveyor 40 move the container 1 forward so that pre-positioning rollers 54 can press down on the handle 12, as shown in FIG. 13. This positioning allows handle 12 to be pushed onto the finish to allow threaded application chuck 52 to engage the container. In will be understood that the pre-positioning chuck 34, as shown in FIGS. 6A and 6B, can be used in place of the pre-positioning rollers 54.

Figure 14:
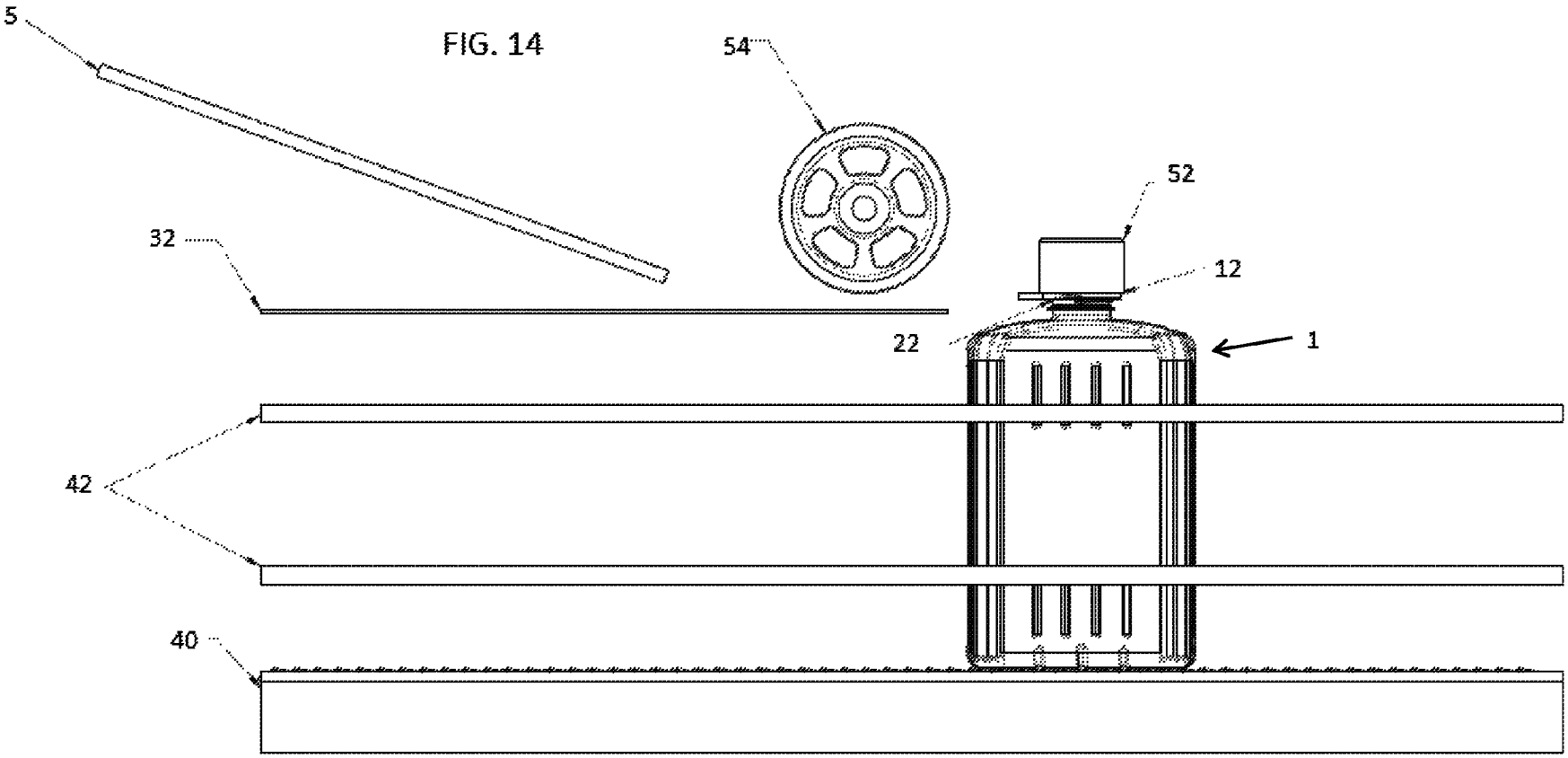
FIG. 14 is a side view showing a threaded application chuck screwing pushing a handle onto a neck of a container.

Once the handle 12 has been properly positioned by pre-positioning rollers 54, the container 1 is released from the neck guide rails 32. As shown in FIG. 14, a threaded application chuck 52 descends and engages threads 26 of neck 20. The threaded application chuck 52 is screwed onto threads 26 of the neck 20, pushing the handle 12 toward container body 10 and over support rib 28. During the application of the handle 12, the conveyor guide rails 42 prevent the container 1 from rotating. Once the handle 12 is moved over the support rib 28, the threaded application chuck 52 is unscrewed from the threads 26 of the neck 20 and the container 1.

Figure 15:
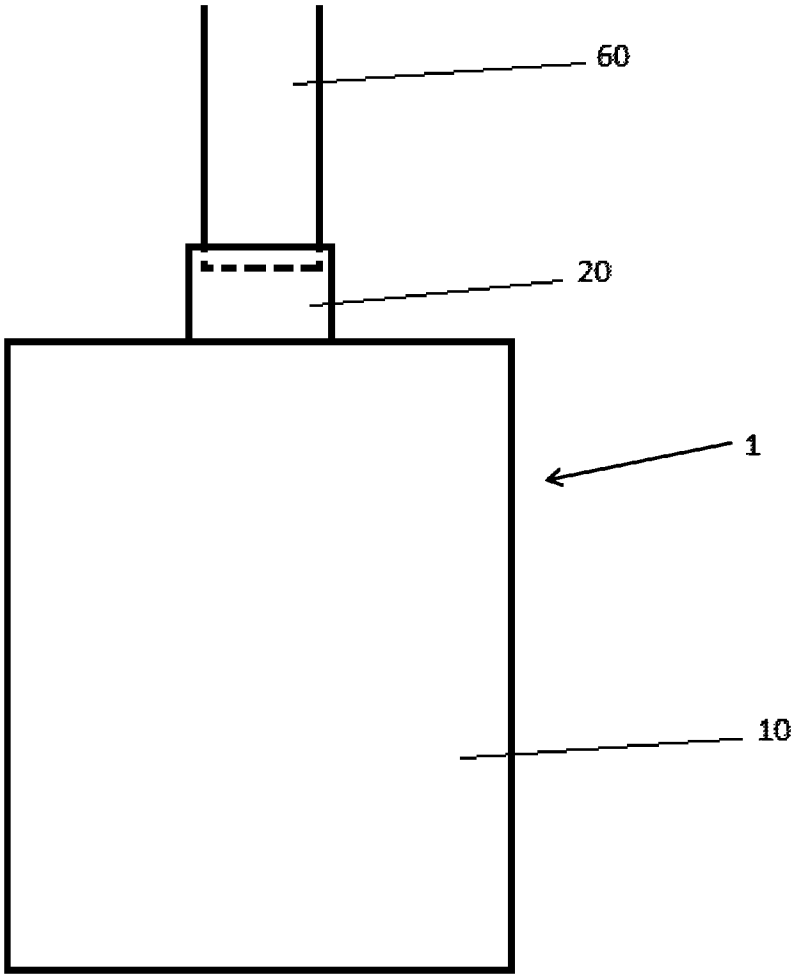
FIG. 15 is a side view showing an expandable device being placed in a neck of a container.
Figure 16:
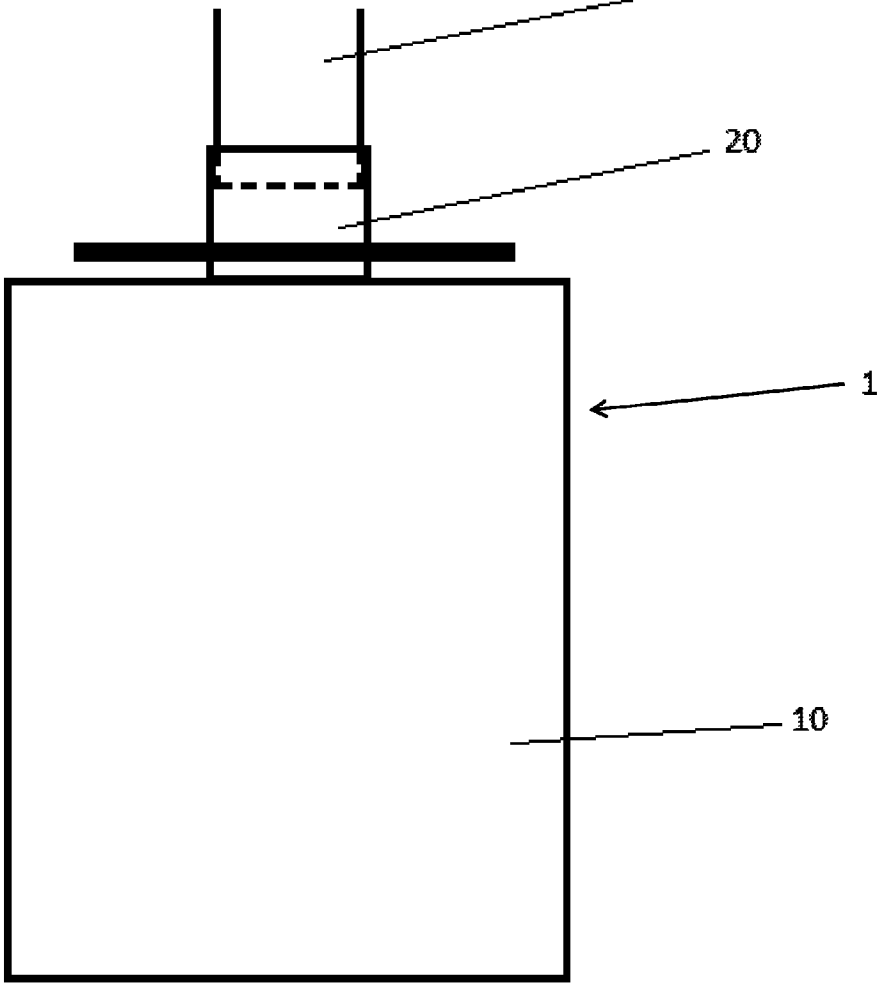
FIG. 16 is a side view showing an expandable device expanded in a neck of a container and a handle on the neck of the container.

In yet another exemplary example, an expander 60 can help apply the handle to the neck 20. As discussed in other exemplary embodiments, the container 1 may move along the conveyor 40 and have a handle 12 placed on the neck 20 of the container 1. Once this occurs, an expander 60 in an unexpanded state may be placed into the neck 20, as shown in FIG. 15. Once the expander 60 is placed in the device, it may expand to engage the an inner wall of the neck 20, as shown in FIG. 16.

When the expander 60 engages the inner wall of the neck 20, the neck 20 becomes more rigid and is may be supported by expander 60. At this point, the neck 20 is more rigid than the container body 10. The handle 12 may then be applied to the neck 20 of the container 1. Once the handle 12 is applied to the neck 20 of the container 1, the expander 60 can be brought back to an unexpanded state so that it no longer is engaging the neck 20. After engager 60 has disengaged the neck 20, the engager 60 may be removed from the neck 20.

In one exemplary embodiment, the container 1, handle 12, container cap 14, and neck 20 will be made of PET; however, these items are not limited to PET and can be made of any material known in the art. The container 1 is not limited to any size, but typical sizes are 17.5 pounds or 35 pounds. The handle 12 can be injected molded and the container 1 can be stretch blown. However, embodiments of the invention are not limited thereto.

What is claimed is:

1. An apparatus for applying a handle to a container, comprising:

a neck guide rail to support the container;

a handle guide rail to move the handle into a position above a neck of the container; and a handle applicator for applying the handle onto the neck of the container, the handle applicator comprising first and second support plates that are movable relative to one another and each include a plurality of spaced apart cutouts, the cutouts each having a polygonal configuration.

2. The apparatus of claim 1, wherein the handle applicator includes a handle punch that pushes the handle onto the neck of the container.

3. The apparatus of claim 1, wherein the first and second support plates are identical.

4. The apparatus of claim 1, wherein the second support plate is a mirror image of the first support plate.

5. The apparatus of claim 1, wherein the support plates each have a maximum thickness defined by opposite top and bottom surfaces of the support plates, the cutouts each extending through the maximum thickness of one of the support plates.

6. The apparatus of claim 1, wherein the plurality of spaced apart cutouts includes three spaced apart cutouts that are spaced apart from one another by an arcuate portion of one of the support plates.

7. The apparatus of claim 1, wherein at least one of the cutouts is defined first and second surfaces of a respective one of the support plates and a third surface of the respective one of the support plates that extends from the first surface to the second surface, the first and second surfaces extending transverse to the third surface.

8. The apparatus of claim 1, wherein:

the plurality of spaced apart cutouts of the first support plate includes first and second cutouts and a third cutout positioned between the first and second cutouts;

the plurality of spaced apart cutouts of the second support plate includes fourth and fifth cutouts and a sixth cutout positioned between the fourth and fifth cutouts; and the handle applicator includes a handle punch comprising opposite first and second extension that are configured for disposal in the third and sixth cutouts, a third extension that is configured for disposal in the first and fourth cutouts and a fourth extension that is configured for disposal in the second and fifth cutouts.

9. The apparatus of claim 1, wherein:

the plurality of spaced apart cutouts of the first support plate includes first and second cutouts and a third cutout positioned between the first and second cutouts;

the plurality of spaced apart cutouts of the second support plate includes fourth and fifth cutouts and a sixth cutout positioned between the fourth and fifth cutouts; and the first and second support plates are movable relative to one another between a first orientation in which the first and fourth cutouts are spaced apart from one another and the second and fifth cutouts are spaced apart from one another and a second orientation in which the first and fourth cutouts are in communication with one another and the second and fifth cutouts are in communication with one another.

10. The apparatus of claim 1, wherein:

the plurality of spaced apart cutouts of the first support plate includes first and second cutouts and a third cutout positioned between the first and second cutouts;

the plurality of spaced apart cutouts of the second support plate includes fourth and fifth cutouts and a sixth cutout positioned between the fourth and fifth cutouts; and the third and sixth cutouts have an identical configuration.

11. The apparatus of claim 1, wherein the handle guide rail comprises a wall, spaced apart first and second sidewalls that each extend from a top surface of the wall, a first flange that extends toward the second sidewall from the first sidewall, and a second flange that extends towards the first sidewall from the second sidewall.

12. The apparatus of claim 11, wherein:

the top surface, the first sidewall and the first flange define a first channel configured for disposal of a first portion of the handle; and the top surface, the second sidewall and the second flange define a second channel configured for disposal of a second portion of the handle.

13. The apparatus of claim 12, wherein inner surfaces of the flanges define a third channel configured for disposal of a third portion of the handle.

14. The apparatus of claim 11, wherein the wall includes opposite first and second end surfaces that are positioned between the sidewalls, the flanges each extending continuously from the first end surface to the second end surface.

15. The apparatus of claim 14, wherein the first end surface is planar from the first sidewall to the second sidewall and the wall includes an acruate cutout that extends into the second end surface.

16. The apparatus of claim 1, further comprising a conveyor guide rail configured to prevent the container from rotating as the handle is applied to the container, the neck guide rail being positioned between the conveyor guide rail and the handle guide rail.

17. The apparatus of claim 16, wherein the conveyor guide rail comprises a pair of rails that are spaced apart from one another.

18. The apparatus of claim 1, wherein the handle applicator includes a handle punch that pushes the handle onto the neck of the container, the handle punch comprising a base and a plurality of spaced apart extensions that extend from the base, the base including a hole that extends through a thickness of the base configured for disposal of a tube to release a compressed gas into the container.

19. An apparatus for applying a handle to a container, comprising:

a neck guide rail to support the container;

a handle guide rail to move the handle into a position above a neck of the container;

a conveyor guide rail configured to prevent the container from rotating as the handle is applied to the container, the neck guide rail being positioned between the conveyor guide rail and the handle guide rail; and a handle applicator for applying the handle onto the neck of the container, the handle applicator comprising identical first and second support plates that each include a plurality of spaced apart cutouts, the support plates each having a maximum thickness defined by opposite top and bottom surfaces of the support plates, the cutouts each extending through the maximum thickness of one of the support plates.

20. An apparatus for applying a handle to a container, comprising:

a neck guide rail to support the container;

a handle guide rail to move the handle into a position above a neck of the container; and a handle applicator for applying the handle onto the neck of the container, the handle applicator comprising identical first and second support plates that each include a plurality of spaced apart cutouts, the handle applicator comprising a handle punch comprising a base and a plurality of spaced apart extensions that extend from the base, the extension being configured for disposal in the cutouts, the base including a hole that extends through a thickness of the base configured for disposal of a tube to release a compressed gas into the container.

* * * * *